US007979272B2

(12) United States Patent
Kang et al.

(10) Patent No.: US 7,979,272 B2
(45) **Date of Patent: *Jul. 12, 2011**

(54) SYSTEM AND METHODS FOR CONCEALING ERRORS IN DATA TRANSMISSION

(75) Inventors: Hong-Goo Kang, Chatham, NJ (US); Hong Kook Kim, Chatham, NJ (US)

(73) Assignee: AT&T Intellectual Property II, L.P., Atlanta, GA (US)

( * ) Notice: Subject to any disclaimer, the term of this patent is extended or adjusted under 35 U.S.C. 154(b) by 699 days.

This patent is subject to a terminal disclaimer.

(21) Appl. No.: 11/871,699

(22) Filed: Oct. 12, 2007

(65) Prior Publication Data

US 2008/0033716 A1 Feb. 7, 2008

Related U.S. Application Data

(63) Continuation of application No. 10/002,030, filed on Oct. 26, 2001, now Pat. No. 7,379,865.

(51) Int. Cl.
*G10L 19/04* (2006.01)

(52) U.S. Cl. ..... 704/219; 704/223; 704/207; 704/230; 704/222; 704/208

(58) Field of Classification Search ..... 704/219, 704/223, 226–228, 207, 230, 222, 208, 262, 704/236

See application file for complete search history.

(56) References Cited

U.S. PATENT DOCUMENTS

| | | | | |
|---|---|---|---|---|
| 5,642,465 | A | 6/1997 | Scott et al. | |
| 6,757,654 | B1 | 6/2004 | Westerlund et al. | |
| 6,842,733 | B1 * | 1/2005 | Gao et al. | 704/224 |
| 6,850,884 | B2 | 2/2005 | Gao et al. | |
| 6,937,979 | B2 * | 8/2005 | Gao et al. | 704/230 |
| 6,980,528 | B1 * | 12/2005 | LeBlanc et al. | 370/290 |
| 6,990,195 | B1 * | 1/2006 | LeBlanc et al. | 379/406.08 |
| 7,092,365 | B1 * | 8/2006 | Tackin et al. | 370/286 |
| 7,379,865 | B2 * | 5/2008 | Kang et al. | 704/219 |
| 2002/0143527 | A1 * | 10/2002 | Gao et al. | 704/223 |

OTHER PUBLICATIONS

Chu, et al., Subband AFPCM Coding for Wideband Audio Signals Using Analysis-by-Synthesis Quantization Scheme, Proceedings ISSIPNN, Apr. 1994.

Wang, et al., "A Voicing-Driven Packet Loss Recovery Algorithm for Analysis-by-Synthesis Predictive Speech Coders Over Internet", IEEE Transactions on Multimedia, Mar. 2001.

Noll, et al., "Reconstruction of Missing Speech Frames Using Sub-Band Excitation", Proceedings of the IEEE-SP, Jun. 1996.

De Martin, et al., "Improved Frame Erasure Concealment for CELP-Based Coders", ICASSP Proceedings, Jun. 2000.

Kang, et al., "A Frame Erasure Concealment Algorithm Based on Gain Parameter Re-Estimation for CELP Coders", IEEE Signal Proceedings Letters, vol. 8, No. 9, Sep. 2001.

* cited by examiner

*Primary Examiner* — Vijay B Chawan

(57) ABSTRACT

The present invention provides a frame erasure concealment device and method that is based on reestimating gain parameters for a code excited linear prediction (CELP) coder. During operation, when a frame in a stream of received data is detected as being erased, the coding parameters, especially an adaptive codebook gain $g_p$ and a fixed codebook gain $g_c$, of the erased and subsequent frames can be reestimated by a gain matching procedure. By using this technique with the IS-641 speech coder, it has been found that the present invention improves the speech quality under various channel conditions, compared with a conventional extrapolation-based concealment algorithm.

22 Claims, 5 Drawing Sheets

SYSTEM AND METHODS FOR CONCEALING ERRORS IN DATA TRANSMISSION

This application is a continuation of U.S. patent application Ser. No. 10/002,030 filed Oct. 26, 2001 entitled SYSTEM AND METHODS FOR CONCEALING ERRORS IN DATA TRANSMISSION, currently allowed as U.S. Pat. No. 7,379,865, which is incorporated herein by reference.

BACKGROUND OF THE INVENTION

1. Field of Invention

The present invention relates to transmission of data streams with time- or spatially dependent correlations, such as speech, audio, image, handwriting, or video data, across a lossy channel or media. More particularly, the present invention relates to a frame erasure concealment algorithm that is based on reestimating gain parameters for a code excited linear prediction (CELP) coder.

2. Description of Related Art

When packets, or frames, of data are transmitted over a communication channel, for example, a wireless link, the Internet, or radio broadcast, some data frames may be corrupted or erased, i.e., by the channel delay, so that they are not available or are altogether lost when the data frames are needed by a receiver. Frame erasure occurs commonly in wireless communications networks or packet networks. Channel impairments of wireless networks can be due to the noise, co-channel and adjacent channel interference, and fading. Frame erasure can be declared when the bit errors are not corrected. Also, frame erasure can result from network congestion and the delayed transmission of some data frames or packets.

Currently, when a frame of data is corrupted, an error concealment algorithm can be employed to provide replacement data to an output device in place of the corrupted data. Such error handling algorithms are particularly useful when the frames are processed in real-time, since an output device will continue to output a signal, for example to loudspeakers in the case of audio, or video monitor in the case of video. The concealment algorithm employed may be trivial, for example, repeating the last output sample or last output frame or data packet in place of the lost frame or packet. Alternatively, the algorithm may be more complex, or non-trivial.

In particular, there are a wide range of frame erasure concealment algorithms embedded in the current standard code excited linear prediction (CELP) coders that are based on extrapolating the speech coding parameters of an erased frame from the parameters of the last good frame. Such a technique is commonly referred to as an extrapolation method.

For example, a receiver using the extrapolation method, upon discovering an erased frame can attenuate an adaptive codebook gain $g_p$ and a fixed codebook gain $g_c$ by multiplying the gain of a previous frame by predefined attenuation factors. As a result, the speech coding parameters of the erased frame are basically assigned with slightly different or scaled-down values from the previous good frame. However, as described in greater detail below, the reduced gains can cause a fluctuating energy trajectory for the decoded signal and thus degrade the quality of an output signal.

SUMMARY OF THE INVENTION

The present invention provides a frame erasure concealment device and method that is based on reestimating gain parameters for a code excited linear prediction (CELP) coder.

During operation, when a frame in a stream of received data is detected as being erased, the coding parameters, especially an adaptive codebook gain $g_p$ and a fixed codebook gain $g_c$, of the erased and subsequent frames can be reestimated by a gain matching procedure.

Contrary to the extrapolation method, the present invention can include an additional block that reestimates the adaptive codebook gain and the fixed codebook gain for an erased frame along with subsequent frames. As a result, any abrupt change caused in a decoded excitation signal by a simple scaling down procedure, such as in the above-described extrapolation method, can be reduced. By using such a technique with an IS-641 speech coder, it has been found that the present invention improves the speech quality under various channel conditions, compared with the conventional extrapolation-based concealment algorithm.

BRIEF DESCRIPTION OF THE DRAWINGS

The present invention will be readily appreciated and understood from consideration of the following detailed description of exemplary embodiments of the present invention, when taken with the accompanying drawings, wherein like numeral reference like elements, and wherein.

DETAILED DESCRIPTION OF PREFERRED EMBODIMENTS

Figure 1:
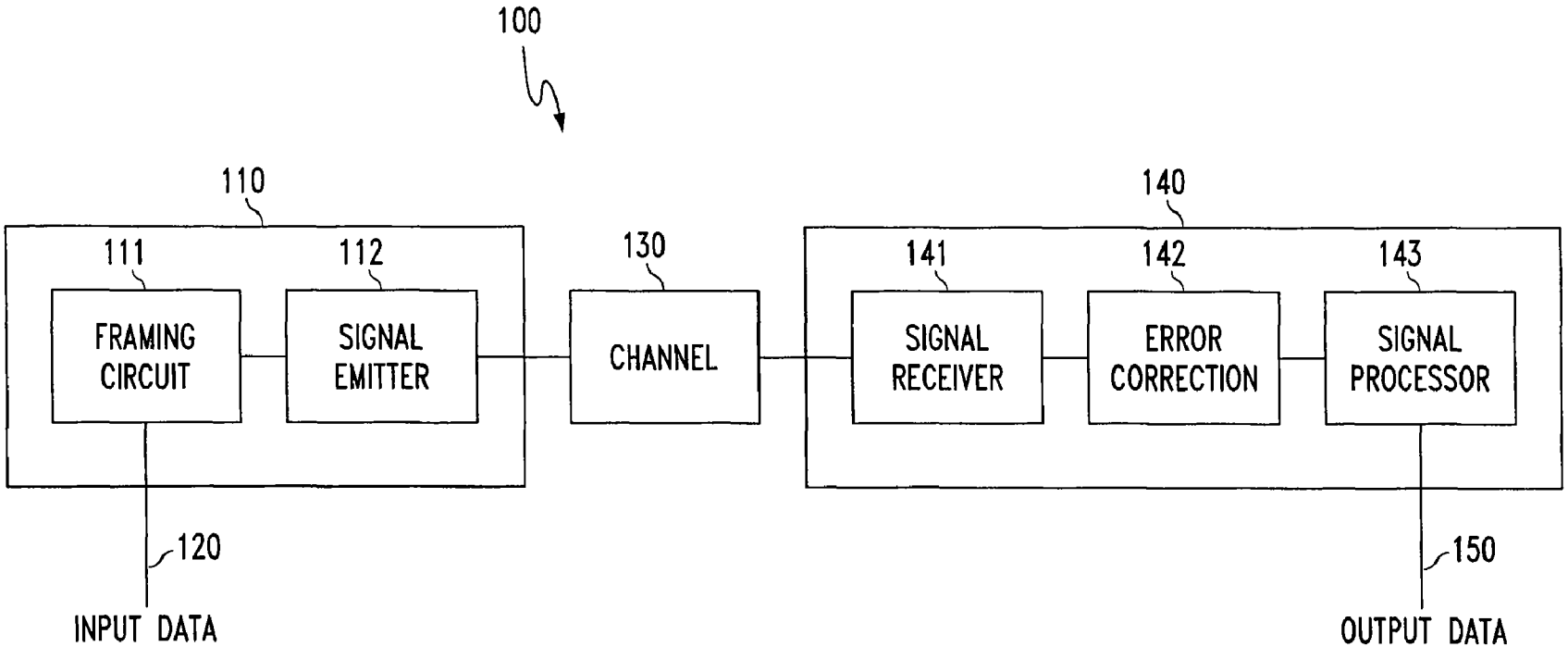
FIG. 1 is a block diagram showing an exemplary transmission system.

FIG. 1 shows an exemplary block diagram of a transmission system 100 according to the present invention. The transmission system 100 includes a transmitter unit 110 and a receiver unit 140. In operation, the transmitter unit 110 receives an input data stream from an input link 120 and transmits a signal over a lossy channel 130. The receiver unit 140 receives the signal from lossy channel 130 and outputs an output data stream on an output link 150. It should be appreciated that the data stream could be any known or later developed kind of signal representing data. For example, the data stream may be any combination of data representing audio, video, graphics, tables and text.

The input link 120, output link 150 and lossy channel 130 can be any known or later developed device or system for connection and transfer of data, including a direct cable connection, a connection over a wide area network or a local area network, a connection over an intranet, a connection over the Internet, or a connection over any other distributed network or system. Further, it should be appreciated that links 120 and 150 and channel 130 can be a wired or a wireless link.

The transmitter unit 110 can further include a framing circuit 111 and a signal emitter 112. The framing circuit 111 receives data from input link 120 and collects an amount of input data into a buffer to form a frame of input data. It is to be understood that the frame of input data can also include additional data necessary to decode the data at receiver unit 140. The signal emitter 112 receives the data from framing circuit 111 and transmits the data frames over lossy channel 130 to receiver unit 140.

The receiver unit 140 can further include a signal receiver 141, an error correction circuit 142 and a signal processor 143. The signal receiver circuit 141 can receive signals from lossy channel 130 and transmit the received data to error correction circuit 142. The error correction circuit can correct any errors in the received data and transmit the corrected data to signal processor 143. The signal processor 143 can then convert the corrected data into an output signal, such as by re-assembling the frames of received data into a signal representative of human speech.

The error correction circuit 142 detects certain types of transmission errors occurring during a transmission over lossy channel 130. Transmission errors can include any distortion or loss of the data between the time the data is input into the transmitter until it is needed by the receiver for processing into an output stream or for storage. Transmission errors are also considered to occur when the data is not received by the time that the output data are required for output link 150. If the data or data frames are error-free, the frame data can be transmitted to signal processor 143. Alternatively, if a transmission error has occurred, error correction circuit 142 can attempt to recover from the error and then transmit the corrected data to signal processor 143. Once signal processor 143 receives the data, the signal processor 143 can then reassemble the data into an output stream and transmit it as output data on link 150.

As described above, a currently used method of error correction is the extrapolation method. For example, in IS-641 speech coding, the number of consecutive erased frames is modeled by a state machine with seven states. State 0 means no frame erasure, and the maximum number of consecutive erased frames is six. During operation, if the n-th frame is detected as an erased frame, using the extrapolation method, the IS-641 speech coder extrapolates the speech coding or spectral parameters of an erased frame using the following equation:

$$\omega_{n,i}=C\omega_{n-1,i}+(1-C)\omega_{dc,i}\ i=1,\ldots,p \tag{1}$$

where $\omega_{n,i}$ is the i-th line spectrum pairs (LSP) of the n-th frame and $\omega_{dc,i}$ is the empirical mean value of the i-th LSP over a training database. The variable c is a forgetting factor set to 0.9, and p is the LPC analysis order of 10.

Depending on the state, an adaptive codebook gain $g_p$ and a fixed codebook gain $g_c$ can be obtained by multiplying predefined attenuation factors by the gains of the previous frame. In other words, $g_p$=P(state) $g_p(-1)$ and $g_c$=C(state) $g_c(-1)$, where $g_p(-1)$ and $g_c(-1)$ are the gains of the last good subframe. In IS-641, P(1)=0.98, P(2)=0.8, P(3)=0.6, P(4)=P(5)=P(6)=0.6 and C(1)=C(2)=C(3)=C(4)=0.98, C(5)=0.9, C(6)=0.6. Further, a long-term prediction lag T is slightly modified by adding one to the value of the previous frame, and the fixed codebook shape and indices are randomly set.

With the above method, the speech coding parameters are basically assigned with slightly different or scaled-down values from the previous good frame in order to prevent the speech decoder from generating a reverberant sound. However, in the case of a single frame erasure or less bursty frame erasures (in other words, when the state is 1 or 2), the reduced gains cause a fluctuating energy trajectory for the decoded speech and thus give an annoying effect to the listeners.

Figure 2:
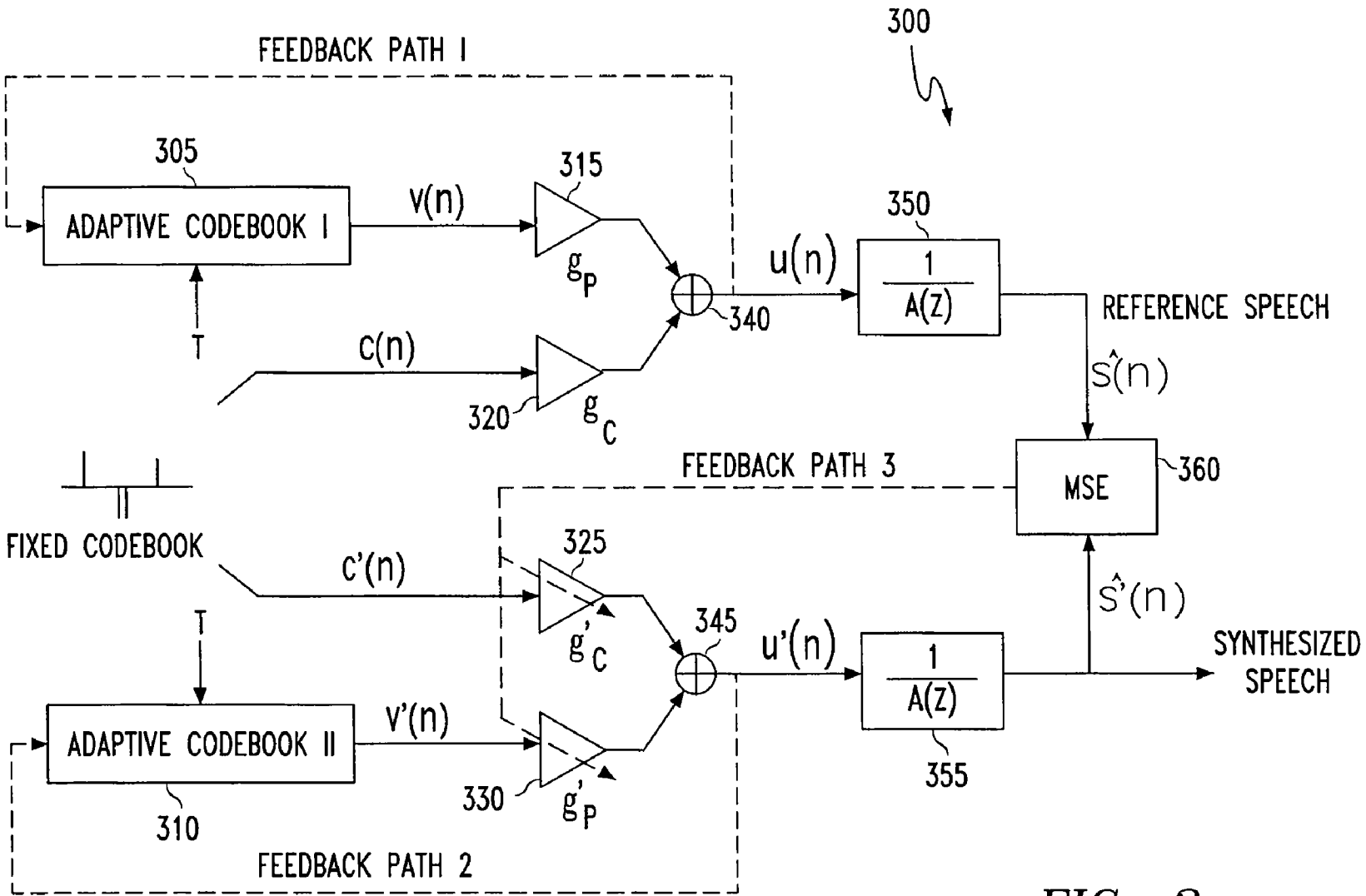
FIG. 2 is an exemplary block diagram of a frame erasure concealment device in accordance with the present invention.

FIG. 2 shows an exemplary block diagram of a frame erasure concealment system in accordance with the present invention. The frame erasure concealment device 300 includes adaptive codebook I 305, adaptive codebook II 310, amplifiers 315-330, summers 340, 345, synthesis filters 350, 355 and mean squared error block 360.

In operation, the frame erasure concealment device 300 can determine transmitter parameters from the received data. The transmitter parameters are encoded at the transmitting side, and can include: a long-term predication lag T; gain vectors $g_p$ and $g_c$; fixed codebook; and linear prediction coefficients (LPC) A(z).

The long-term prediction lag T parameter can be used to represent the pitch interval of the speech signal, especially in the voiced region.

The adaptive and fixed codebook gain vectors $g_p$ and $g_c$, respectively, are the scaling parameters of each codebook.

The fixed codebook can be used to represent the residual signal that is the remaining part of the excitation signal after long-term prediction.

And the LPC coefficients A(z) can represent the spectral shape (vocal tract) of the speech signal.

Based on the long-term prediction lag T, the adaptive codebook I 305 can generate an adaptive codebook vector v(n) that subsequently is passed through amplifier 315 and into summer 340. The amplifier 315 amplifies the adaptive codebook vector v(n) at a gain of $g_p$, as derived from the transmitting parameters.

In a similar manner, based on the fixed codebook, a fixed codebook vector c(n) passes through amplifier 320 and into summer 340. The gain of amplifier 320 is equal to the gain vector $g_c$ as derived from the transmitting parameters.

The summer 340 then adds the amplified adaptive codebook vector, $g_p$ v(n), and the amplified fixed codebook vector, $g_c$ c(n), to generate an excitation signal u(n). The excitation signal u(n) is then transmitted to the synthesis filter 350. Additionally, the excitation signal u(n) is stored in the buffer along feedback path 1. The buffered information will be used to find the contribution of the adaptive codebook I 305 at the next analysis frame.

The synthesis filter 350 converts the excitation signal into reference signal ŝ(n). The reference signal is then transmitted to the mean squared error block 360.

Additionally, as shown in FIG. 2, the present invention includes the additional adaptive codebook memory (Adaptive Codebook II 310) that can be updated every subframe. During operation, the adaptive codebook II 310 determines a modified adaptive codebook vector v'(n) that can be calculated using the same long-term prediction lag T as that used to calculate the adaptive codebook vector v(n). Additionally, a modified fixed codebook vector c'(n) is generated that is equal to c(n) that is set randomly for an erased frame. In a similar manner to that described above, the modified fixed codebook vector c'(n), which is equal to c(n), is transmitted through amplifier 325 and into summer 345. The gain of the amplifier 325 is $g'_c$. Similarly, the modified adaptive codebook vector v'(n) is passed through amplifier 330 and into the summer 345. The gain of the amplifier 330 is $g'_p$.

The output of the summer 345 is the modified excitation signal u'(n). The modified excitation signal is transmitted to the synthesis filter 355. Additionally, the modified excitation signal is stored in the buffer along feedback path 2, which will be used to obtain the contribution of the adaptive codebook II 310 at the next analysis frame.

The synthesis filter 355 converts the modified excitation signal u'(n) into a modified reference signal ŝ'(n). For an erased frame, the reference signal ŝ(n) of the block diagram is obtained in a similar manner to that of the extrapolation method. One difference is that the state-dependent scaling factors P(state) and C(state) are modified to alleviate the abrupt gain change of the decoded signal. In other words, P(1)=1, P(2)=0.98, P(3)=0.8, P(4)=0.6, P(5)=P(6)=0.6 and C(1)=C(2)=C(3)=C(4)=C(5)=0.98, C(6)=0.9. In order to prevent unwanted spectral distortion, the constant of c in equation (1) can be set to 1, and the previous long-term prediction lag T without any modifications up to state 3 can be used. The modified reference signal is transmitted to the mean squared error block 360.

The mean squared error block 360 can determine new gain vectors $g'_p$ and $g'_c$ so that a difference between the two synthesized speech signals $\hat{s}(n)$ and $\hat{s}'(n)$ is minimized. In other words, $g'_p$ and $g'_c$ can be chosen according to equation (2):

$$\min_{g'_p, g'_c} \sum_{n=0}^{N_s-1} (\hat{s}(n) - \hat{s}'(n))^2 = \min_{g'_p, g'_c} \sum_{n=0}^{N_s-1} (h(n) * (u(n) - (g'_p v'(n) + g'_c c'(n))))^2 \quad (2)$$

where $N_s$ is the subframe size and h(n) is the impulse response corresponding to 1/A(z). By setting the partial derivatives of equation (2) with respect to $g'_p$ and $g'_c$ to zero, the optimal values of $g'_p$ and $g'_c$ can be obtained.

From informal listening tests, it has been found that instead of using the optimal values of $g'_p$, $g'_c$, quantizing $g'_p$, $g'_c$ gives a smoother energy trajectory for the synthesized speech. In other words, a gain quantization table can be used to store predetermined combinations of gain vectors $g'_c$ and $g'_p$. Subsequently, entries in the gain quantization table can be systematically inserted into the equation (2), and a selection that minimizes equation (2) can ultimately be selected. This is a similar quantization scheme as used in the IS-641 speech coder. Also, the adaptive codebook memory and the prediction memory used for the gain quantization can be updated like the conventional speech decoding procedure.

As shown in FIG. 2, the synthesized speech can be generated based on the selected vector gains, by passing the excitation signal, $u'(n)=g'_p v'(n)+g'_c c'(n)$, through the synthesis filter 355. The synthesized speech signal can then be transmitted to a postprocessor block in order to generate a desired output.

With the above-described frame erasure concealment device 300, when a frame is detected as being erased, the coding parameters, especially the adaptive codebook gain $g'_p$ and fixed codebook gain $g'_c$, of the erased and subsequent frames are reestimated by a gain matching procedure. By doing so, any abrupt change caused in the decoded excitation signal by a simple scaling down procedure, such as in the extrapolation method, can be reduced. Further, this technique can be applied to the IS-641 speech coder in order to improve speech quality under various channel conditions, compared with the conventional extrapolation-based concealment algorithm.

The present invention can additionally be utilized as a preprocessor. In other words, this present invention can be inserted as a module just before the conventional speech decoder. Therefore, the invention can easily be expanded into the other CELP-based speech coders.

Figures 3A, 3B, 3C, 3D, 3E:
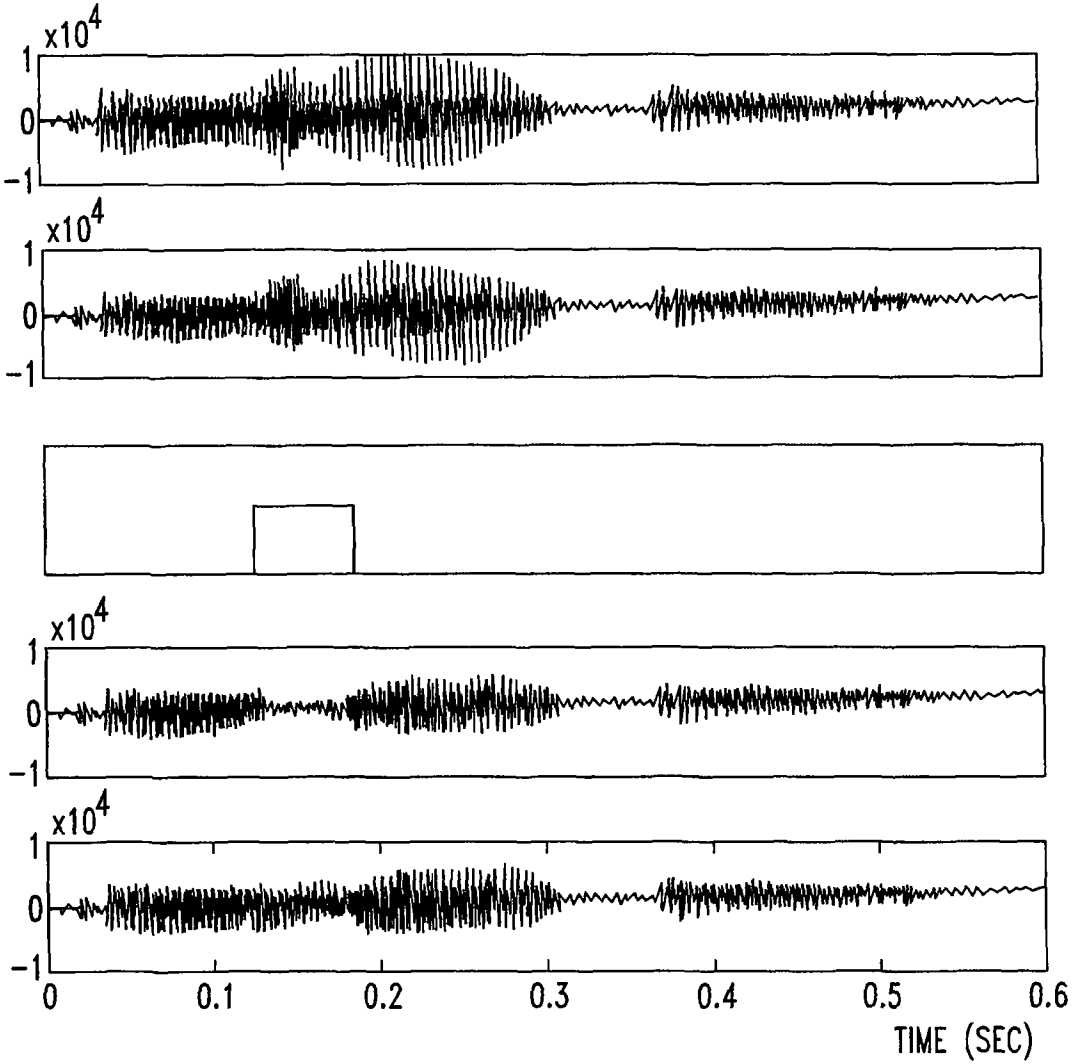
FIGS. 3*a*-3*e* are a series of signal plots that represent exemplary speech patterns.

FIGS. 3*a*-3*e* show an example of speech quality degradation when bursty frame erasure occurs. FIG. 3*a* shows a sample speech pattern. FIG. 3*b* shows IS-641 decoded speech without any frame errors. FIG. 3*c* shows a step function that represents a portion of the sampled speech pattern where a bursty frame erasure occurs.

FIG. 3*d* shows a speech pattern that is recreated from the original speech pattern by using the extrapolation methods, shown in FIG. 3*a*, transmitted across a lossy channel that includes the bursty frame erasure, shown in FIG. 3*c*. As shown, during the time period when the frame erasure occurs, the extrapolation method continues decreasing the gain values of the erased frames until a good frame is detected. Consequently, the decoded speech for the erased frames and a couple of subsequent frames has a high level of magnitude distortion as shown in FIG. 3*d*.

FIG. 3*e* shows a speech pattern that is recreated from the original speech pattern of FIG. 3*a* including the bursty frame erasure of FIG. 3*c*. As shown in FIG. 3*e* using the present error concealment method reduces a distortion caused by the bursty frame erasure. As described above, this is accomplished by combining the modification of scaling factors and the reestimation of codebook gains, and thus, improving decoded speech quality.

Figure 4A:
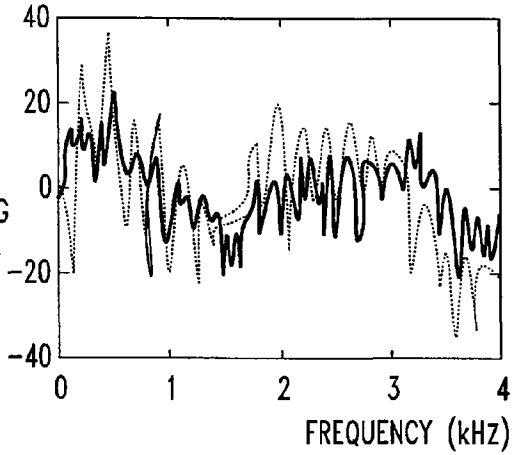
FIG. 4 is a series of signal plots showing a comparison between various error concealment techniques.
Figure 4C:
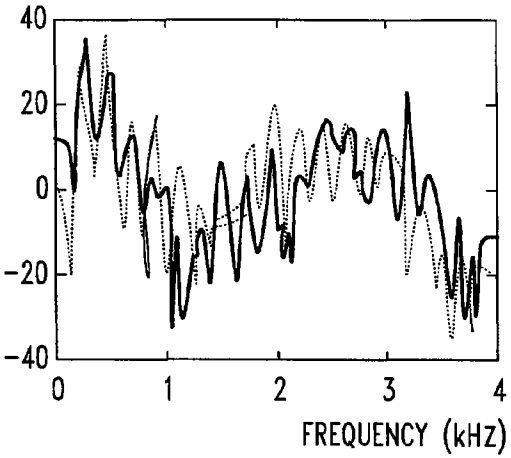
Figure 4B:
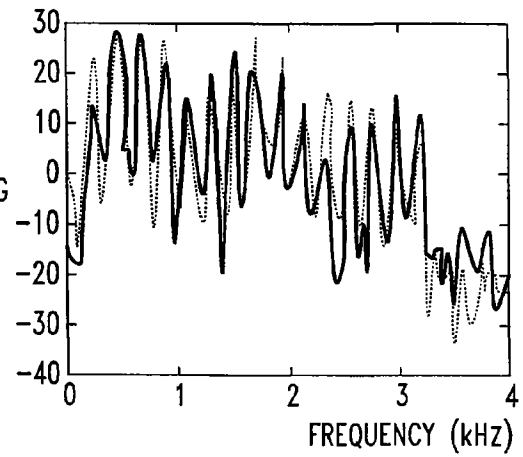
Figure 4D:
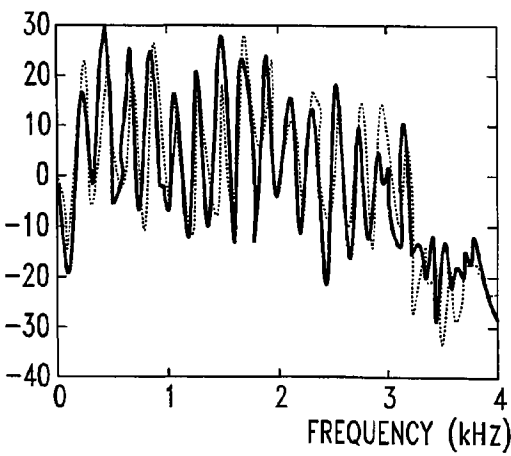

FIGS. 4*a*-4*d* show a normalized logarithmic spectra obtained by both the extrapolation method and the present error concealment method, where the spectrum without any frame error is denoted by a dotted line. In this example, spectrum is obtained by applying a 256-point FFT to the corresponding speech segment of 30 ms duration. The starting time of the speech segment in FIGS. 4*a* and 4*b* is 0.14 sec, and the starting time is 0.18 sec in FIGS. 4*c* and 4*d*. Therefore, FIGS. 4*a* and 4*b* provide information of the spectrum matching performance during the frame erasure, and FIGS. 4*c* and 4*d* show the performance just after reception of the first good frame.

As evident from the figures, compared to the error-free spectrum, the present error concealment method gives a more accurate spectrum of the erased frames, especially in low frequency regions, than the extrapolation method. Further, the present error concealment method recovers the error-free spectrum more quickly than the conventional extrapolation method.

Figure 5:
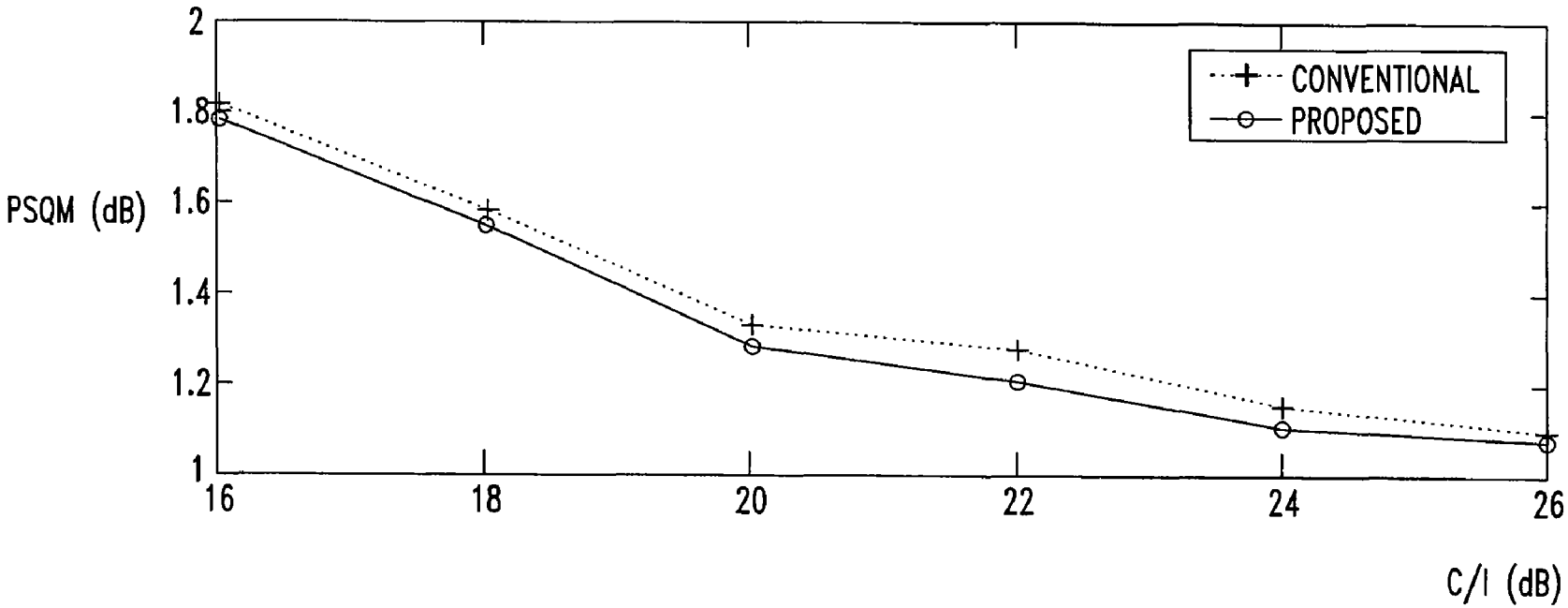
FIG. 5 is a series of plots comparing an extrapolation method to the method of the present invention.

FIG. 5 shows a graph of a perceptual speech quality measure (PSQM) versus a channel quality (C/I). As shown in FIG. 5, where the channel quality is low (i.e., a low C/I value) the value of the perceived quality of the present concealment method is better (i.e., a lower PSQM value) than that of a conventional method, such as the extrapolation method. Additionally, with the channel quality as high (i.e., a high C/I value) the value of perceived quality of the present concealment method is also better than that of a conventional method. In this example, PSQM was chosen as an objective speech quality measure, which also gives high correlations to the mean opinion score (MOS) even under some impaired channel conditions.

Below, Table I shows the PSQMs of the IS-641 decoded speech combined with the conventional frame erasure concealment algorithm and the error concealment method of the present invention. In order to show the effectiveness of the modified scaling factors, the proposed gain reestimation method has been implemented with the original IS-641 scaling factors and the performance is compared with the modified scaling factors.

TABLE I

| | | Proposed | |
|---|---|---|---|
| FER (%) | Conventional | IS-641 Scaling | Modified Scaling |
| 0 | 1.045 | 1.045 | 1.045 |
| 3 | 1.354 | 1.299 | 1.298 |
| 5 | 1.470 | 1.379 | 1.365 |
| 7 | 1.803 | 1.627 | 1.614 |
| 10 | 2.146 | 1.939 | 1.908 |

As shown, the frame error rate (FER) is randomly changed from 3% to 10%. As FER increases, the PSQM increases for the two algorithms. However, the present error concealment algorithm has better (i.e., lower) PSQMs than the conventional algorithm for all the FERs. Accordingly, the gain reestimation method with the modified scaling factors gives better performance than that with the IS-641 scaling factors. This is because the probability that the consecutive frame erasure would occur goes higher as the FER increases.

Below, Table II shows the PSQMs according to the burstiness of FER, where the FER is set to 3%.

TABLE II

| | | Proposed | |
|---|---|---|---|
| Burstiness | Conventional | IS-641 Scaling | Modified Scaling |
| 0.0 | 1.354 | 1.299 | 1.298 |
| 0.2 | 1.236 | 1.225 | 1.228 |
| 0.4 | 1.335 | 1.272 | 1.262 |
| 0.6 | 1.349 | 1.242 | 1.227 |
| 0.8 | 1.330 | 1.261 | 1.240 |
| 0.95 | 1.333 | 1.271 | 1.244 |

As shown, the present method with the modified scaling factors performs better than that with the IS-641 scaling factors in high burstiness. The speech quality is not always degraded as the burstiness increases. This is because the bursty frame errors can occur in the silence frames and luckily these errors doe not degrade speech quality. From the table, it was also found that the present gain reestimation method with the modified scaling factors was more robust than the conventional one.

Subsequently, an AB preference listening test was performed, where 8 speech sentences (4 males and 4 females) were processed by both the conventional algorithm and the proposed one under a random frame erasure of 3%. These sentences were presented to 8 listeners in a randomized order. The result in Table III shows that the present method gives better speech quality than the conventional one.

TABLE III

| Talkers | Conventional | Proposed |
|---|---|---|
| Male | 13 | 19 |
| Female | 7 | 25 |
| Total | 20 (31.25%) | 44 (68.75%) |

Further, the complexity of the present method was compared to the conventional one. The complexity estimates are based on evaluation with weighted million operations per second (WMOPS) counters. As shown in Table IV, the proposed algorithm needs an additional 0.98 WMOPS in worst case. This increased amount is relatively low compared to the total codec complexity that reaches more than 13 WMOPS.

TABLE IV

| Function | Conventional | Proposed |
|---|---|---|
| Decoding | 0.79 | 1.77 |
| Postfiltering | 0.75 | 0.75 |
| Total (Decoder) | 1.54 | 2.52 |

While the present invention has been described in conjunction with the exemplary embodiments outlined above, it is evident that many alternatives, modifications and variations will be apparent to those skilled in the art. Accordingly, the exemplary embodiments of the present invention, as set forth above, are intended to be illustrative, not limiting. Various changes may be made without departing from the spirit and scope of the present invention.

What is claimed is:

1. A method for mitigating errors in frames of a received communication in a device, comprising:

modifying the received communication for determining a reference signal;

modifying the received communication for determining a modified reference signal; and adjusting an adaptive codebook gain parameter by a processor of the device for an adaptive codebook and a fixed codebook gain based on a difference between the reference signal and the modified reference signal.

2. The method according to claim 1, wherein the reference signal is determined based on a transmitting parameter of the received communication.

3. The method according to claim 2, wherein the transmitting parameter comprises a long-term prediction lag.

4. The method according to claim 3, wherein the reference signal is determined by adding an adaptive codebook vector with a fixed codebook vector to form an excitation signal, and passing the excitation signal through a synthesis filter.

5. The method according to claim 4, wherein the adaptive codebook vector is based on the long-term prediction lag.

6. The method according to claim 5, wherein the adaptive codebook vector is amplified by an adaptive codebook gain vector $g_p$ and the fixed codebook vector is amplified by a fixed codebook gain vector $g_c$ prior to being added together to form the excitation signal.

7. The method according to claim 6, wherein the difference between the reference signal and the modified reference signal is based on a mean squared error between the reference signal and the modified reference signal.

8. The method according to claim 7, wherein the difference between the reference signal and the modified reference signal is based on the mean squared error between the reference signal and the modified reference signal, wherein the difference is minimized.

9. The method according to claim 8, wherein the difference between the reference signal and the modified reference signal is minimized according to the equation:

$$\min_{g'_p, g'_c} \sum_{n=0}^{N_s-1} (h(n) * (u(n) - (g'_p v'(n) + g'_c c'(n))))^2$$

where $N_s$ is a subframe size and h(n) is an impulse response corresponding to 1/A(z).

10. The method according to claim 2, wherein the reference signal is determined by adding an adaptive codebook vector with a fixed codebook vector to form an excitation signal and passing the excitation signal through a synthesis filter.

11. The method according to claim 10, wherein the adaptive codebook vector is amplified by an adaptive codebook gain vector $g_p$ and the fixed codebook vector is amplified by a fixed codebook gain vector $g_c$ prior to being added together to form the excitation signal.

12. An apparatus for mitigating errors of a communication, comprising:

a signal receiver that receives a communication; and a device coupled to the signal receiver that modifies the communication for determining a reference signal, modifies the communication for determining a modified reference signal, and adjusts an adaptive codebook gain parameter for an adaptive codebook and a fixed codebook gain based on a difference between the reference signal and the modified reference signal.

13. The apparatus according to claim 12, wherein the device determines the reference signal based on a transmitting parameter of the communication.

14. The apparatus according to claim 13, wherein the transmitting parameter comprises a long-term prediction lag.

15. The apparatus according to claim 14, wherein the device determines the reference signal by adding an adaptive codebook vector with a fixed codebook vector to form an excitation signal, and passing the excitation signal through a synthesis filter.

16. The apparatus according to claim 15, wherein the adaptive codebook vector is based on the long-term prediction lag.

17. The apparatus according to claim 16, wherein the adaptive codebook vector is amplified by an adaptive codebook gain vector $g_p$ and the fixed codebook vector is amplified by a fixed codebook gain vector $g_c$ prior to being added together to form the excitation signal.

18. The apparatus according to claim 17, wherein the device determines the difference between the reference signal and the modified reference signal based on a mean squared error between the reference signal and the modified reference signal.

19. The apparatus according to claim 18, wherein the device determines the difference between the reference signal and the modified reference signal based on the mean squared error between the reference signal and the modified reference signal, wherein the difference is minimized.

20. The apparatus according to claim 19, wherein the device minimizes the difference between the reference signal and the modified reference signal according to the equation:

$$\min_{g'_p, g'_c} \sum_{n=0}^{N_s-1} (h(n) * (u(n) - (g'_p v'(n) + g'_c c'(n))))^2$$

where $N_s$ is a subframe size and h(n) is an impulse response corresponding to 1/A(z).

21. The apparatus according to claim 13, wherein the device determines the reference signal by adding an adaptive codebook vector with a fixed codebook vector to form an excitation signal and passing the excitation signal through a synthesis filter.

22. The apparatus according to claim 21, wherein the adaptive codebook vector is amplified by an adaptive codebook gain vector $g_p$ and the fixed codebook vector is amplified by a fixed codebook gain vector $g_c$ prior to being added together to form the excitation signal.

* * * * *